US006397001B1

(12) United States Patent
Montagnino et al.

(10) Patent No.: US 6,397,001 B1
(45) Date of Patent: May 28, 2002

(54) VAPORIZER WITH MINERAL SALT ADDITIVE

(75) Inventors: James G. Montagnino, St. Charles; Bob Czajkowski, Tinley Park; Peter Delmenico, Evanston; Peter Ehling, Chicago, all of IL (US)

(73) Assignee: Sunbeam Products, Inc., Boca Raton, FL (US)

( * ) Notice: Subject to any disclaimer, the term of this patent is extended or adjusted under 35 U.S.C. 154(b) by 0 days.

(21) Appl. No.: 09/482,824

(22) Filed: Jan. 13, 2000

(51) Int. Cl.[7] ..... F22B 1/30; H05B 3/60

(52) U.S. Cl. ..... 392/333; 392/327; 392/337

(58) Field of Search ..... 392/322, 323, 392/324, 327, 329, 331, 336, 337, 338, 386, 39 F, 402, 403, 405, 406; 122/4 A; 261/139, 141, 142, DIG. 46, DIG. 65

(56) References Cited

U.S. PATENT DOCUMENTS

| | | | | | |
|---|---|---|---|---|---|
| 184,948 | A | | 12/1876 | Adgate et al. | |
| 335,559 | A | | 12/1886 | Bowers et al. | |
| 2,733,693 | A | | 12/1956 | Johnson | |
| 2,804,056 | A | | 8/1957 | Whiting | |
| 2,847,549 | A | | 8/1958 | Schmitt et al. | |
| 3,518,409 | A | * | 6/1970 | Corbett | 392/337 |
| 3,521,604 | A | | 7/1970 | Nickel | |
| 3,775,589 | A | * | 11/1973 | Camp | 392/337 |
| 3,915,819 | A | * | 10/1975 | Bell et al. | 205/696 |
| 4,139,762 | A | * | 2/1979 | Pohrer et al. | 392/402 |
| 4,163,895 | A | * | 8/1979 | Hauser et al. | 392/333 |
| 4,463,248 | A | | 7/1984 | Katzman et al. | |

* cited by examiner

*Primary Examiner*—Sang Paik
(74) *Attorney, Agent, or Firm*—Kramer, Levin, Naftalis and Frankel LLP

(57) ABSTRACT

A vaporizer having a heating chamber which may be quickly and easily removed and replaced when scale buildup interferes with the operation of the vaporizer. The vaporizer may have an improved electrode configuration, whereby the bottom portion of the electrodes provide most of the boiling energy. The vaporizer may be easily and safely maintained, as user access to the electrodes is prevented. In addition, a vaporizer is described having an electrode cartridge which may be quickly and easily removed for replacement or cleaning. A unique reservoir design provides for a flat or rising lip surrounding the main reservoir opening, which allows the reservoir to be compatible with dishwasher cleaning. The vaporizer may be provided with mineral salts to enhance the flow of electric current between the vaporizer elements.

13 Claims, 7 Drawing Sheets

VAPORIZER WITH MINERAL SALT ADDITIVE

FIELD OF THE INVENTION

The present invention relates to vaporizers; more specifically to a vaporizer providing replaceable and disposable or easily cleanable components, having improved electrodes, and having a container with mineral salts to enhance the flow of electric current between vaporizer elements.

BACKGROUND INFORMATION

A vaporizer provides steam or moist air to a room by heating and thus evaporating water. This may be done to make a room more comfortable and to provide a healthier environment.

A typical vaporizer includes a reservoir holding water and a boiling chamber (also called a heating unit, evaporation chamber or boiling cup) accepting water from the reservoir. The boiling chamber includes two electrodes, commonly manufactured from stainless steel, which may be, for example, flat plates, one inch wide and four inches long, which are separated by a distance of approximately one half inch. Each electrode is connected directly to one lead of a conventional 120 volt household electric current supply. The electrodes are submerged in water supplied from the reservoir, and electric current flowing between the electrodes and through the water heats the water to the point of boiling. Steam and water vapor are formed and flow out of a hole in the boiling chamber, humidifying the surrounding air. The boiling chamber concentrates heat provided by the electrodes in a space which is smaller than the reservoir, allowing for faster boiling.

The water in the reservoir is usually supplied from a household tap, and thus contains various dissolved solids and minerals. These dissolved solids and minerals stay behind in the boiling chamber as the water evaporates, and collect on the electrodes and in the chamber as a white, flaky powder called scale. Scale buildup lowers the efficiency of a vaporizer by electrically insulating the electrodes and by taking up space in the boiling chamber which may otherwise be used for water. Eventually, scale buildup will cause a vaporizer to cease working entirely.

In the past consumers have been required to remove vaporizer scale buildup by periodically washing the boiling chamber and electrodes. One recommended method is soaking the electrodes and boiling chamber in vinegar. The inconvenience of this maintenance is a barrier to the use of such vaporizers. Furthermore, some consumers simply do not wash the boiling chamber. In such a case the vaporizer soon ceases to work, resulting in consumer dissatisfaction. Maintenance may also pose a safety hazard. Typically, a lid or cover may be opened so that the user may access the boiling chamber. Opening this lid typically disables the delivery of current to the electrodes in the boiling chamber, since the level of current at the electrodes is the full voltage from the home electrical supply. However, such safety systems may work imperfectly or may be defeated. The reservoir for such vaporizers may be cleaned using a dishwasher. However, imperfect dishwasher cleaning may result, as such reservoirs have a downward facing lip surrounding an upper opening. When inverted in a dishwasher the downward facing lip prevents proper drainage, and water and soap may collect around the inside of the lip, preventing complete cleaning.

A certain amount of dissolved minerals are required for a conventional vaporizer to operate, for example to allow sufficient electric current to pass between the electrodes. While over a period of time dissolved minerals may accumulate in a vaporizer boiling chamber, when a clean or new boiling chamber is first used, the mineral concentration in the water may be too low to enable effective boiling. The dissolved mineral content in tap water varies widely according to household and region, and some consumers may use distilled water in an attempt to extend the life of such vaporizers and eliminate scale buildup. Therefore manufacturers have provided instructions to consumers to add mineral salts to low mineral content water to enable the flow of electrical current between vaporizer terminals.

In conventional vaporizers, as the water level in the reservoir falls, thereby lowering the water level in the boiling chamber, the electrodes become less submerged. Therefore, as the water level drops, less of the electrodes are exposed, and the efficiency of the vaporizer diminishes.

Therefore, there exists a need for a vaporizer which requires less maintenance than prior art vaporizers, which may be easily and safely maintained, and which has components which are compatible with dishwasher cleaning. There also exists a need for a vaporizer which provides an adequate amount of starter salts or minerals the first time the vaporizer or boiling chamber is used, thereby eliminating the need for a user to add mineral salts or for the use of a pump or other extra equipment. There is a need for a vaporizer where the efficiency of the vaporizer does not diminish as the water level in the reservoir falls.

SUMMARY OF THE INVENTION

An exemplary embodiment of the vaporizer of the present invention provides a heating chamber which may be quickly and easily removed and replaced when scale buildup interferes with the operation of the vaporizer. The vaporizer may have an improved electrode configuration, whereby the bottom portion of the electrodes provide most of the boiling energy. The vaporizer may be easily and safely maintained, as user access to the electrodes is prevented. In an another embodiment of the present invention, an electrode cartridge may be quickly and easily removed for replacement or cleaning. A unique reservoir design provides for a flat or rising lip surrounding the main reservoir opening, which allows the reservoir to be compatible with dishwasher cleaning. In a further exemplary embodiment a vaporizer is provided having a quantity of mineral salts supplied with the boiling chamber to enhance the flow of electric current between the vaporizer elements.

DETAILED DESCRIPTION OF THE INVENTION

An exemplary embodiment of the vaporizer of the present invention provides a heating chamber which may be quickly and easily removed and replaced when scale buildup interferes with the operation of the vaporizer. The vaporizer may be easily and safely maintained, as user access to the electrodes is prevented. Furthermore, the user is prevented from viewing unsightly scale buildup. In an another embodiment of the present invention, an electrode cartridge may be removed for replacement or cleaning.

In the following description, various aspects of the present invention will be described. For purposes of explanation, specific configurations and details are set forth in order to provide a thorough understanding of the present invention. However, it will also be apparent to one skilled in the art that the present invention may be practiced without the specific details. Furthermore, well known features are omitted or simplified in order not to obscure the present invention.

Figure 1:
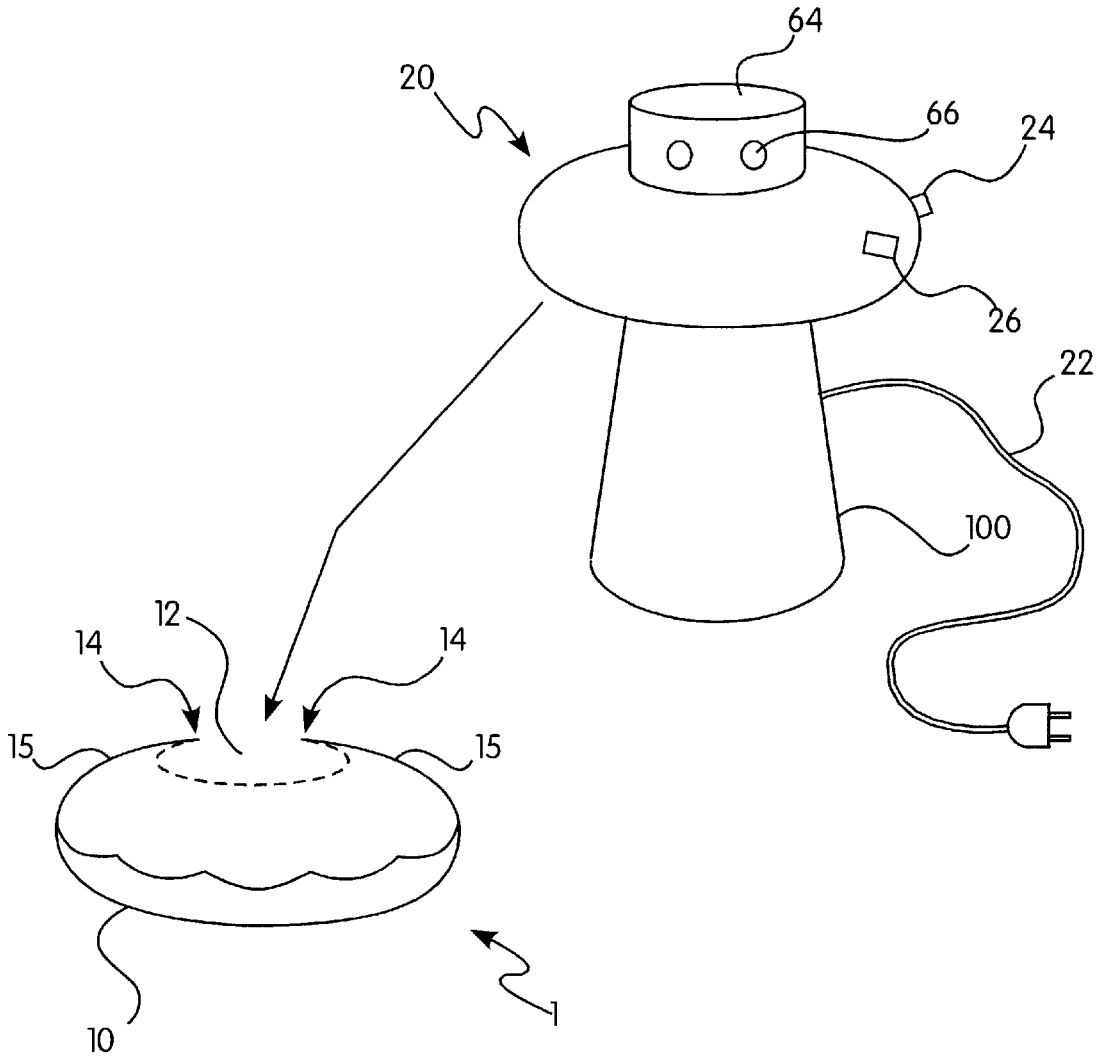
FIG. 1 depicts a vaporizer 1 according to an exemplary embodiment of the present invention.

FIG. 1 depicts a vaporizer 1 according to an exemplary embodiment of the present invention. The vaporizer 1 includes, for example, a reservoir 10 for holding water and having an opening 12 for accepting a vaporizing unit. The opening 12 defines, for example, an annular ledge 14. The vaporizing unit also includes, for example, a removable head unit 20 fitting in the opening 12 and resting on the annular ledge 14. Removable head 20 also supports, for example, a replaceable boiling chamber 100 according to embodiment of the present invention. In FIG. 1, the head unit 20 is illustrated as being removed from the vaporizer 1. The annular ledge 14 may have, for example, a notch or inset conforming to a tab or extension on the head unit 20 for keeping the head unit 20 aligned in a certain direction. The head unit 20 may be removed so that the reservoir 10 may be cleaned or so that, for example, the boiling chamber 100 may be replaced. The head unit 20 also includes a power cord 22, which attaches to a conventional 120 volt home power supply, an on/off switch 24, and an on/off indicator 26, which may be, for example, a lamp. The head unit 20 further includes a vaporizer horn 64, for exhausting steam and water vapor, and having one or more fresh air ports 66. The fresh air ports 66 allow ambient air to enter the space defined by the vaporizer horn 64 and to mix with the hot steam and water vapor, cooling the steam and water vapor to prevent burns.

In an exemplary embodiment, the lip defined by the annular ledge 14 and the area 15 on the upper portion of the reservoir 10 immediately surrounding the annular ledge 14 are upward sloping or flat, and do not slope downward. Therefore, when the reservoir 10 is inverted it may substantially drain. This contour of the area 15 and the annular ledge 14 enables the reservoir 10 to be dishwasher compatible, as the reservoir 10 may drain when placed upside down in a dishwasher, and, unlike conventional vaporizers, does not collect water, soap, or other substances inside a downward turning lip (which turns upward when the reservoir 10 is inverted). Other shapes or contours may be included in the area 15 or the annular ledge 14, such as a notch or inset, or ridges, bumps or cut outs, and a portion of the annular ledge 14 or the area 15 may be contoured to be downward turning. If a substantial portion of the annular ledge 14 or the area 15 is flat or upward sloping, adequate drainage is ensured. For example, a portion of the annular ledge 14 or the area 15 may be upward sloping or rising, and another portion may be flat.

Figure 2:
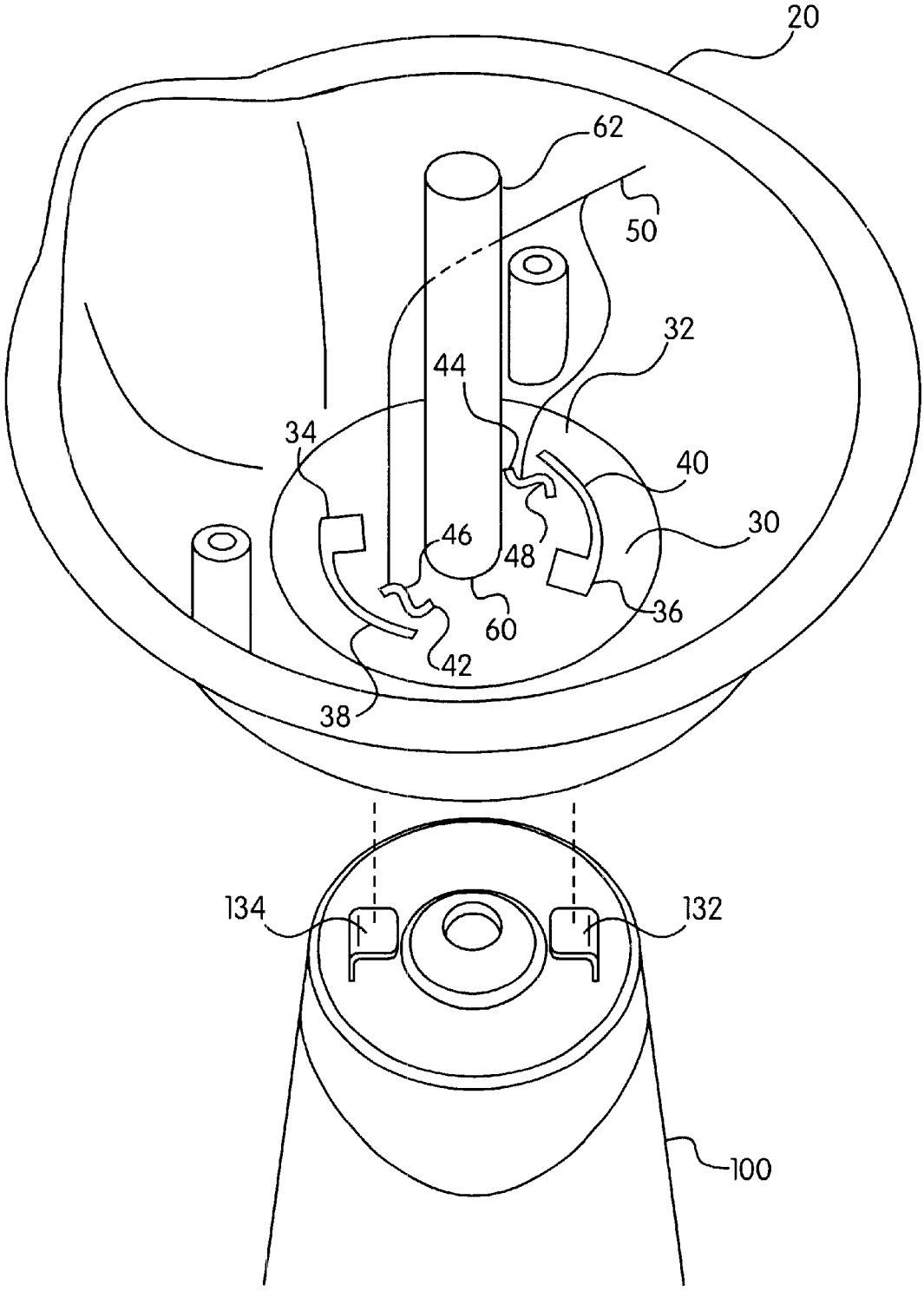
FIG. 2 is a cut-away view of the head unit of FIG. 1 according to an exemplary embodiment of the present invention.

FIG. 2 is a cut-away view of the head unit of FIG. 1 according to an exemplary embodiment of the present invention. In FIG. 2, the top of the head unit 20 has been cut away to reveal its interior, and the boiling chamber 100 is depicted separated from the head unit 20. The bottom wall 30 of the head unit 20 includes, for example, a head unit connecting plate 32 for connecting to and holding the boiling chamber 100. The boiling chamber 100 includes electrode tabs 132 and 134, for joining with the head unit connecting plate 32 to secure the boiling chamber 100 to the head unit 20. The head unit connecting plate 32 includes, for example, two electrode ports 34 and 36, two electrode slots 38 and 40 disposed in the interior of the head unit 20, and two electrode connectors 42 and 44 disposed in the interior of the head unit 20. Electrode connector 42 includes an contact portion 46 (e.g., a stamped metal contact) and electrode connector 44 includes an contact portion 48. The electrode ports 34–36, the electrode slots 38 and 40, and the electrode connectors 42 and 44 allow electrode tabs 132 and 134 disposed on the boiling chamber 100 to physically and removeably connect the boiling chamber 100 to the head unit 20 and provide electric power to the boiling chamber 100.

The electrode connectors 42 and 44 are electrically connected to the power cord 22 (FIG. 1) and the on/off switch 24 via supply wires 50; the on/off switch 24 also provides power to the on/off indicator 26. In an exemplary embodiment, one lead of a two lead 120 volt power supply connects to the electrode connector 42 and the other lead connects to the electrode connector 44. Alternatively, a switch may be positioned between the power supply and the electrode connectors. The head unit connecting plate 32 includes, for example, a head unit outlet hole 60 disposed in the bottom wall 30, for accepting water vapor and steam from the boiling chamber 100. An exhaust tube 62 for carrying water vapor and steam extends upwards from the head unit outlet hole 60 within the head unit 20. The exhaust tube 62 empties to the vaporizer horn 64 (FIG. 1), having one or more fresh air ports 66.

Figure 3:
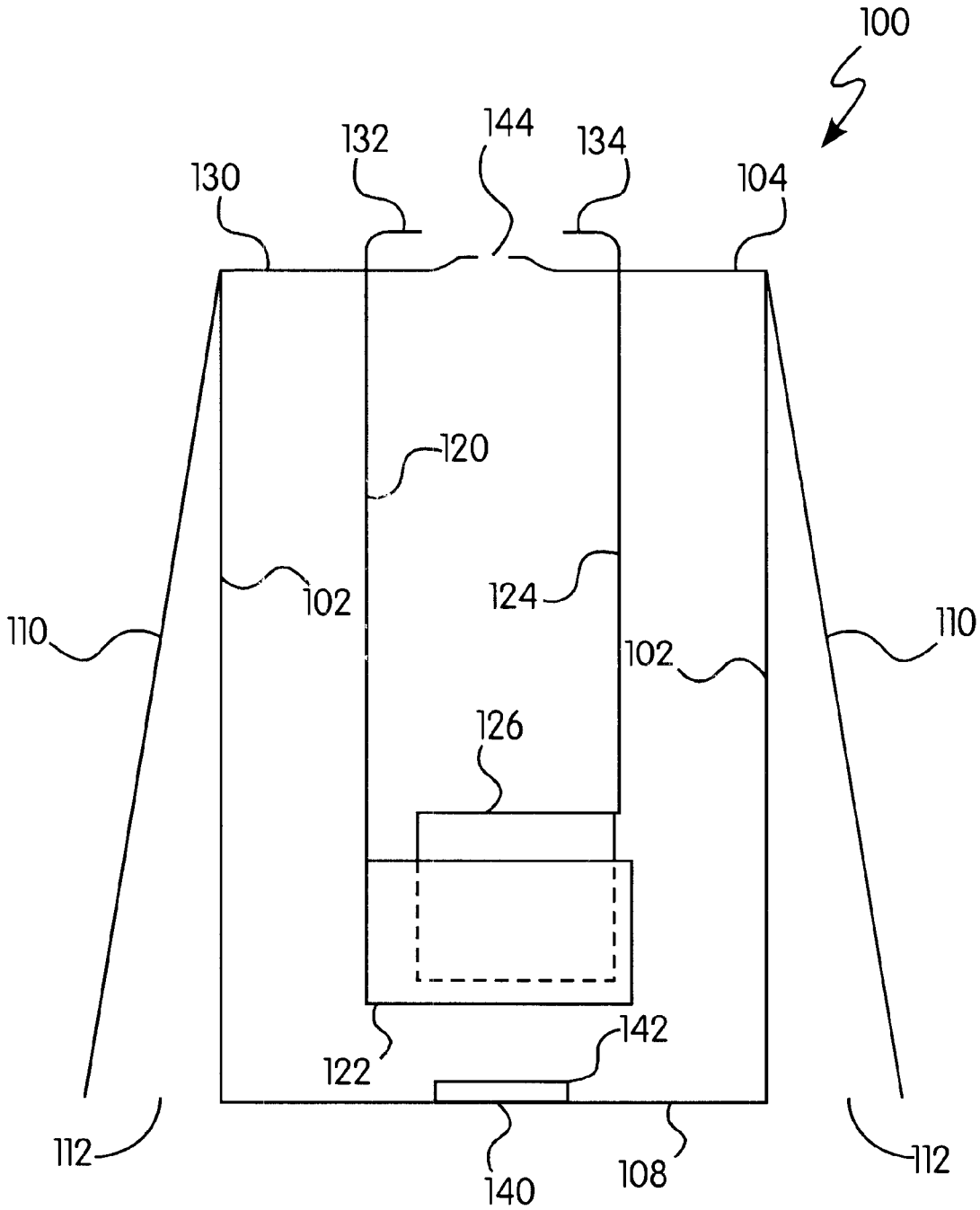
FIG. 3 is a cut-away view of the boiling chamber of FIG. 1 according to an exemplary embodiment of the present invention.

FIG. 3 is a cut-away view of the boiling chamber of FIG. 1 according to an exemplary embodiment of the present invention. When attached to the head unit 20 (FIG. 1), the boiling chamber 100 extends downward from the head unit 20 for vaporizing the water supplied by the reservoir 10 (FIG. 1). The boiling chamber 100 is, for example, a hollow rectangular box with a side wall 102, a top wall 104, and a bottom wall 108. Alternatively, boiling chamber 100 can have other desired shapes, such as cylindrical. The boiling chamber 100 also includes an outer insulating wall 110 connected to the boiling chamber 100 at or near the top wall 104 of the boiling chamber 100 and forming, for example, a tapered cylinder which expands in diameter towards its bottom. Thus, the general shape of the boiling chamber 100 including the outer insulating wall 110 is a section of a cone. When the boiling chamber 100 is inserted properly into the water filled reservoir 10, the outer insulating wall 110 and the set of side walls 102 define an air filled insulating area 112 which is open at the bottom and closed at the top, where the outer insulating wall 110 meets the boiling chamber 100.

In an exemplary embodiment, two electrodes 120 and 124 extend downward inside the boiling chamber 100 from the top wall 104 of the boiling chamber 100. The electrodes 120 and 124 are, for example, flat stainless steel plates, one inch wide and four inches long, which are parallel and separated by a distance of approximately four inches. The electrodes 120 and 124 also may be formed from a material other than stainless steel.

The electrodes 120 and 124 have electrode extensions 122 and 126, respectively, extending from the bottom portion of the electrodes 120 and 124. Each electrode extension 122 and 126 is perpendicular to the main electrode shaft, and they are spaced approximately one to one half inch from each other. The electrode extensions 122 and 126 may be spaced in another manner allowing sufficient current flow to produce heating and boiling.

In an exemplary embodiment, during operation, most current causing water heating flows between the electrode extensions 122 and 126, rather than between the electrodes 120 and 124. Preferably, the electrodes 120 and 124 are spaced far enough apart (e.g., greater than three inches) so that the current flow between them is not effective to boil water. As the water level in the reservoir 10 falls, thereby lowering the water level in the boiling chamber 10, the electrodes 120 and 124 become less submerged, but the electrode extensions 122 and 126 remain submerged. Therefore, as the water level drops, the efficiency of the vaporizer does not diminish.

In an alternate embodiment, electrode extensions allowing for substantially all the heating to occur at a lower portion of a set of electrodes may be of another configuration. For example, the electrode extensions may be a set of flat horizontal plates, or may form as the electrodes themselves curve towards one another, narrowing the gap between the electrodes. In an alternate embodiment, a conventionally spaced set of electrodes, not having electrode extensions, may be used.

In an exemplary embodiment, the boiling chamber 100 includes a boiling chamber connecting plate 130, (for example, partially formed by the top wall 104) which releasably connects the boiling chamber 100 to the head unit 20 by mating with the head unit connecting plate 32 (FIG. 1). The boiling chamber 100 is removable, and is held in place on the head unit 20 by the head unit connecting plate 32. The boiling chamber connecting plate 130 includes, for example, electrode tabs 132 and 134 disposed on the upper portion of the boiling chamber connecting plate 130, for joining with the head unit connecting plate 32 to secure the boiling chamber 100 to the head unit 20 and to provide electricity to the electrodes 120 and 124. The electrode tabs 132 and 134 are electrically connected to the electrodes 120 and 124, respectively, and in an exemplary embodiment are simply extensions of the electrodes 120 and 124. The electrode tabs 132 and 134 act as, for example, bayonet connectors.

Referring to FIG. 2, to connect the boiling chamber 100 to the head unit 20, the electrode tabs 132 and 134 are placed in the electrode ports 34 and 36, respectively. The electrode tabs 132 and 134 may slide in and out of the electrode ports 34 and 36, but not in and out of the electrode slots 38 and 40. The user rotates the boiling chamber 100, and the electrode tabs 132 and 134 slide along the electrode slots 38 and 40, respectively. The electrode tabs 132 and 134 make contact with the electrode connectors 42 and 44 and are held in place by a friction fit with the contact portions 46 and 48 and the head unit connecting plate 32. The electrode tab 132 connects the electrode connector and the contact portion 46, and the electrode tab 134 connects the electrode connector and the contact portion 48. The electrode tabs 132 and 134 hold the boiling chamber 100 in place on the head unit 20, and also allow for easy installation and removal of the boiling chamber 100.

Referring to FIG. 3, the bottom wall 108 of the boiling chamber 100 includes an intake opening 140 for allowing water to flow from the reservoir 10 into the boiling chamber 100. Preferably the intake opening 140 is too small to allow a user easy access to the inside of the boiling chamber 100. The intake opening 140 may consist of, for example, several openings, and also may include a filter 142 which removes minerals and contaminants from water entering the boiling chamber 100 and thus extends the life of the boiling chamber 100. The filter 142 may include, for example, a known water softening agent or activated charcoal.

The top wall 104 includes a boiling chamber exhaust opening 144 for allowing steam and water vapor to flow from the boiling chamber 100, through the head unit outlet hole 60, through the exhaust tube 62, out of the vaporizer horn 64, and into the surrounding air. Preferably the boiling chamber exhaust opening 144 is too small to allow a user easy access to the inside of the boiling chamber 100. The boiling chamber exhaust opening 144 may consist of, for example, several openings. Preferably the boiling chamber exhaust opening 144 sits on a raised portion extending upwards from the center of the top wall 104; the raised portion extends into the head unit outlet hole 60. The raised portion functions to provide a high point for steam to exit the boiling chamber 100, and aids correct orientation and installation of the boiling chamber 100.

Since the boiling chamber connecting plate 130 is disposed on the top wall 104, the boiling chamber exhaust opening 144 may considered to be on both the top wall 104 and the boiling chamber connecting plate 130. The intake opening 140 and boiling chamber exhaust opening 144 may be disguised to prevent a user from easily viewing the boiling chamber 100.

Preferably the boiling chamber 100 is a substantially sealed enclosure. The boiling chamber 100 is substantially sealed in that openings are provided for water, steam and water vapor, but it is difficult for a user to access the interior of the boiling chamber 100, as preferably the intake opening 140 and boiling chamber exhaust opening 144 are too small to allow fingers, even those of children, to enter the boiling chamber 100. The boiling chamber 100 may be an encased unit which may not be easily disassembled by a user; such a boiling chamber hides unsightly scale buildup from a user. Furthermore, that the boiling chamber is an encased unit improves safety, as the electrodes 120 and 124, which may be live if safety devices and measures are defective or defeated, are inaccessible to the user. Of course, a user may gain access to the enclosure by breaking or disassembling the boiling chamber.

Preferably, most of the non-electrical parts of the vaporizer 1, for example the non-electrical parts of the boiling chamber 100, reservoir 10, and head unit 20, are formed from plastic such as polypropylene or polyethylene which can withstand the heat of boiling water without deforming.

In an exemplary embodiment, to operate the vaporizer 1, a user fills the reservoir 10 with water up to a certain level; a fill line may be provided. In order to fill the reservoir 10 the head unit 20 is removed from the reservoir 10; to operate the vaporizer 1 the head unit 20 is replaced in the reservoir 10. The user plugs the power cord 22 into a wall socket and turns on the on/off switch 24. Power flows from the power cord 22 through the on/off switch 24 to the on/off indicator 26, and also to the electrode connectors 42 and 44 via the supply wires 50. When the boiling chamber 100 is attached to head unit 20, the electrode tabs 132 and 134 are in electrical contact with the electrode connectors 42 and 44, and thus power may flow to the electrodes 120 and 124. The voltage supplied to the electrodes 120 and 124 is of sufficient quantity (e.g., 120 V, 60 Hz) to heat the water which surrounds the electrodes 120 and 124 in the boiling chamber 100 to the boiling point.

Water vapor and steam are formed in the boiling chamber 100, flow up through the boiling chamber exhaust opening 144, through the head unit outlet hole 60, through the exhaust tube 62, out of the vaporizer horn 64, and into the surrounding air. In an exemplary embodiment, a fan is not needed, and steam and water vapor rise and enter the room due to convection. In an alternate embodiment, a fan may be added to aid circulation or evaporation and to propel steam and water vapor into a room. While the water in the boiling chamber 100 is heated considerably, the air trapped between the outer insulating wall 110 and the set of side walls 102 prevents much of this heat from escaping into the water in the surrounding chamber. As water is evaporated from the boiling chamber 100, water flows into the boiling chamber 100 via the intake opening 140.

As water is evaporated from the boiling chamber 100, minerals contained in the water stay behind in the boiling chamber 100 and form scale on the electrodes 120 and 124 and on the inside of the boiling chamber 100. After a period of time, the efficiency of the vaporizer 1 may be reduced due to scale build-up, since the electrodes 120 and 124 are less effective when covered in scale, and since the volume available for water in the boiling chamber 100 is reduced as scale volume increases. Eventually the user will want to replace the boiling chamber 100. According to an exemplary embodiment of the present invention, the user may replace the boiling chamber 100 after steam flow from the vaporizer 1 is reduced, after a certain period of time, or after an indicating device or system (not shown) indicates to the user that the boiling chamber 100 should be replaced.

For example, when scale buildup has rendered the boiling chamber 100 ineffective, it may be removed and replaced. The user unplugs the power cord 22 from the home power supply and removes the head unit 20 and attached boiling chamber 100 from the reservoir 10. In an exemplary embodiment, the head unit 20 simply rests on the annular ledge 14 of the reservoir 10, and may be easily lifted out. The user grasps the head unit 20 in one hand and the boiling chamber 100, for example, in the other hand, and twists the boiling chamber 100 one quarter turn counter-clockwise. The electrode tabs 132 and 134 may disengage from the electrode connectors 42 and 44 and the contact portions 46 and 48, and slide along the electrode slots 38 and 40. The electrode tabs 132 and 134 then exit from the electrode ports 34 and 36, allowing the boiling chamber 100 to become disconnected from the head unit 20. While the head unit 20 is removed from the reservoir 10, the user may clean the reservoir 10 and refill the reservoir 10 with water.

The user may be supplied with a replacement boiling chamber, and may attach the fresh boiling chamber to the head unit 20. For the purposes of explanation, the securing of a new boiling chamber to the head unit 20 will be described with respect to the boiling chamber 100. The user grasps the head unit 20 in one hand and the boiling chamber 100 in the other hand, inserts the electrode tabs 132 and 134 in the electrode ports 34 and 36, and twists the boiling chamber 100 one quarter turn clockwise. As the user rotates the boiling chamber 100, the electrode tabs 132 and 134 slide along the electrode slots 38 and 40. The electrode tabs 132 and 134 contact the electrode connectors 42 and 44 and are held in place by a friction fit with the contact portions 46 and 48. The electrode tabs 132 and 134 hold the boiling chamber 100 in place on the head unit 20. As the user places the head unit 20 and boiling chamber 100 in the reservoir 10, and as the boiling chamber 100 is lowered into the water, air is trapped between the outer insulating wall 110 and the set of side walls 102 of the boiling chamber 100. This air provides heat insulation for the boiling chamber 100.

The boiling chamber 100 may be shaped or may have attachments making it easier to handle. For example, while the top of the boiling chamber 100 may be circular to connect with the head unit, the boiling chamber 100 may be oval shaped near its bottom to enable easier gripping. Alternately, the entire cross section of the boiling chamber may be oval in shape, and join with the head in a manner allowing for an oval cross section. The boiling chamber 100 also may have easily grippable surfaces or attachments. Similarly, the head unit 20 may be shaped or may have attachments making it easier to grip and handle. Other methods of connecting the boiling chamber 100 to the head unit may be used. For example, the boiling chamber may fit into a sleeve extending from the boiling chamber 100; in such a case, the boiling chamber 100 may be attached by, for example, friction fit, or by mating plastic tabs. Other methods of making an electrical connection between the boiling chamber electrodes 120, 124 and the head unit 20 may be used; for example, the boiling chamber 100 may have plugs which plug into the head unit 20.

While in an exemplary embodiment the outer insulating wall is incorporated into the boiling chamber, and is disposed of with the boiling chamber different methods of forming such a sleeve may be used, or such a sleeve may be omitted. For example, in an alternate embodiment of the present inventory the outer insulating wall extends downward from the head unit, forming a sleeve in which the boiling chamber is inserted. In such an embodiment the outer insulating wall may be considered to be an extension of the head unit 20.

An alternate exemplary embodiment of the system and method of the present invention provides a vaporizer where, when scale buildup reduces the efficiency of the vaporizer, the electrodes may removed and replaced. The electrodes may be placed in a cartridge, where the electrodes are mounted on a base. Providing for parts of a vaporizer which may be removed without tools for cleaning or disposal allows for a vaporizer which may be more easily maintained than vaporizers requiring tools to disassemble, or vaporizers without removable components.

Figure 4:
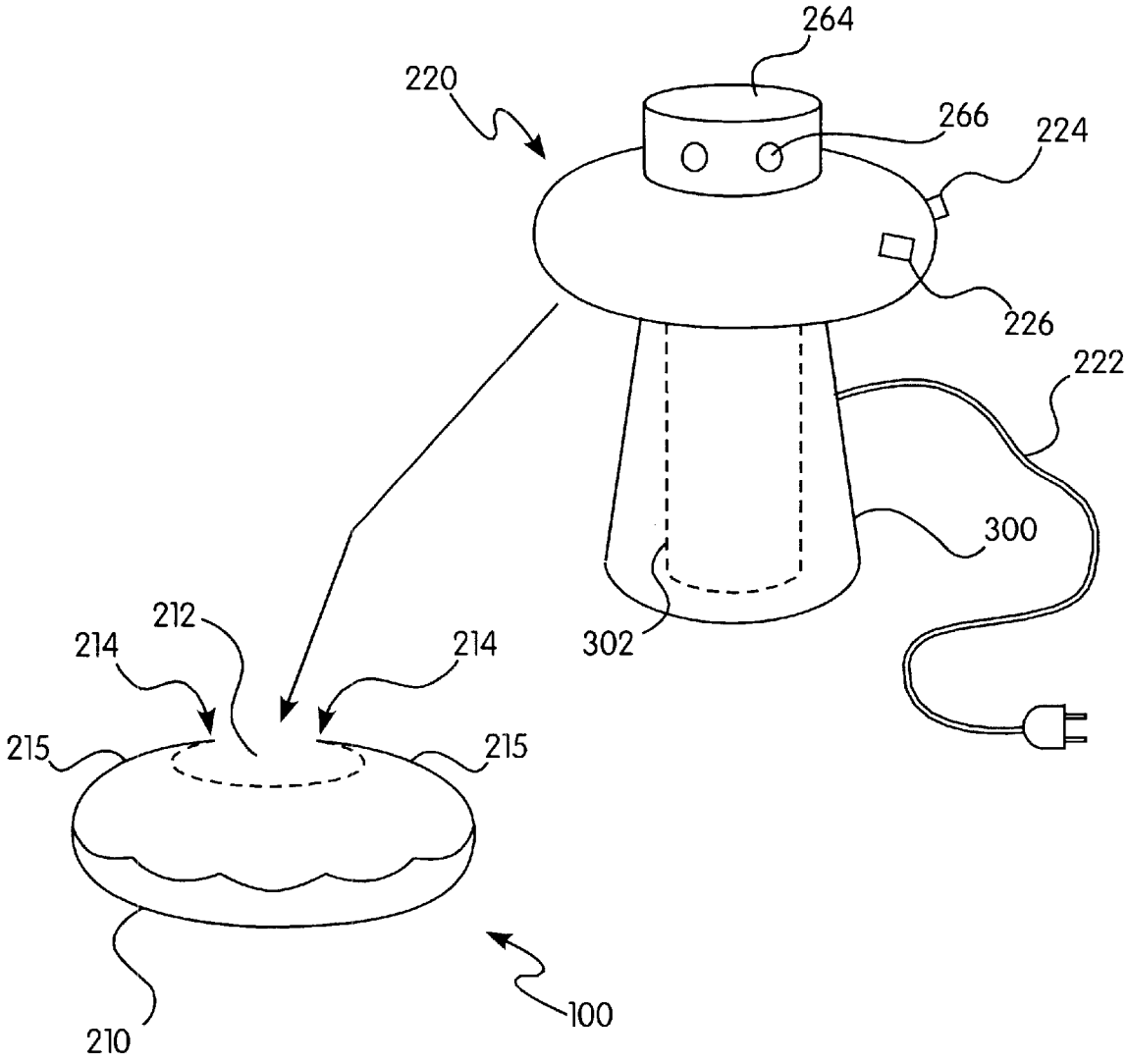
FIG. 4 depicts a vaporizer according to an alternate exemplary embodiment of the present invention.

FIG. 4 depicts a vaporizer 200 according to an alternate exemplary embodiment of the present invention. The vaporizer 200 includes a reservoir 210 for holding water and an opening 212 on top for accepting a removable head unit 220; the opening 212 defines an annular ledge 214. The annular ledge 214 and the area 215 on the upper portion of the reservoir 10 immediately surrounding the annular ledge 214 are, for example, upward sloping or flat, and do not slope downward. Other shapes or contours may be included in the area 215 or annular ledge 214, such as ridges, bumps or cut outs, and a portion of the annular ledge 214 or the area 215 may be contoured to be downward turning. The head unit 220 fits in the opening 212 and rests on the annular ledge 214. The annular ledge 214 may have a notch or inset conforming to a tab or extension on the head unit 220 for keeping the head unit 220 aligned in a certain direction. A boiling chamber 300 extends downward from the head unit 220 and contains a removable electrode cartridge 302. The head unit 220 may be removed so that the reservoir 210 or boiling chamber 300 may be cleaned or so that the electrode cartridge 302 may be replaced. The head unit 220 includes a power cord 222, which attaches to a conventional 120 volt home power supply, an on/off switch 224, and an on/off indicator 226, which may be, for example, a lamp.

Figure 5:
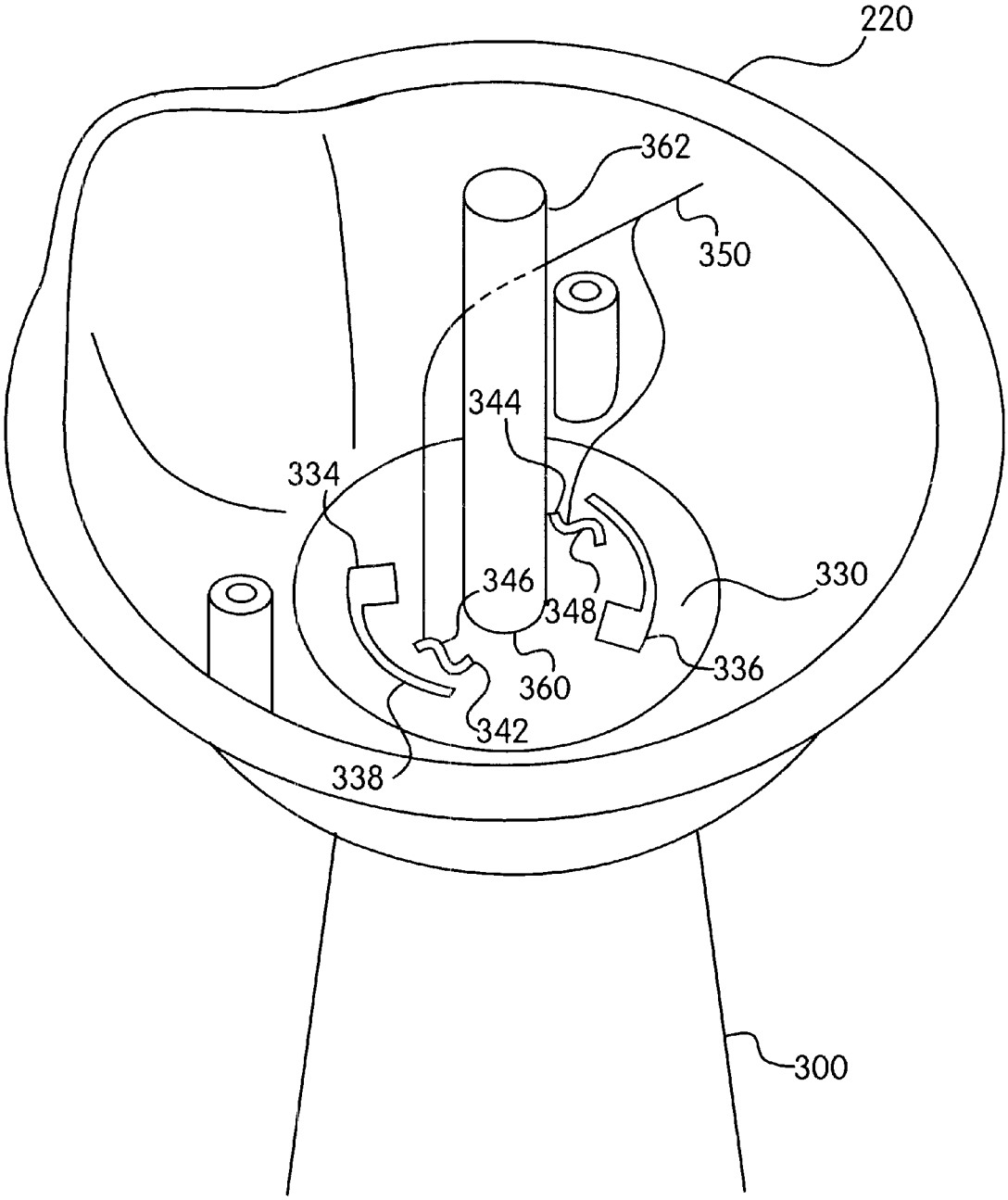
FIG. 5 is a cut-away view of the head unit according to an exemplary embodiment of the present invention.

FIG. 5 is a cut-away view of the head unit 220 according to an exemplary embodiment of the present invention. In FIG. 5, the top of the head unit 220 has been cut away to reveal the interior, and no electrode cartridge has been inserted in the boiling chamber 300. The head unit 220 includes a boiling chamber connecting plate 330, which includes two electrode ports 334 and 336, two electrode slots 338 and 340 disposed in the interior of the head unit 220, and two electrode connectors 342 and 344 disposed in the interior of the head unit 220. Each electrode connector includes a contact portions 346 and 348. The electrode ports 334 and 336, the electrode slots 338 and 340, and the electrode connectors 342 and 344 allow the electrode tabs and disposed on an electrode cartridge (not shown) to physically connect the electrode cartridge to the boiling chamber 300 and provide electric power to the electrode cartridge. The electrode connectors 342 and 344 are electrically connected to the power cord 222 (FIG. 4) and the on/off switch 224 via supply wires 350; the on/off switch 224 also provides power to the on/off indicator 226. The boiling chamber connecting plate 330 includes a boiling chamber outlet hole 360 for accepting water vapor and steam from the boiling chamber 300. An exhaust tube 362 for carrying water vapor and steam extends upwards from the boiling chamber outlet hole 360 within the head unit 220. The exhaust tube 362 empties to the vaporizer horn 264, having one or more fresh air ports 266.

Figure 6:
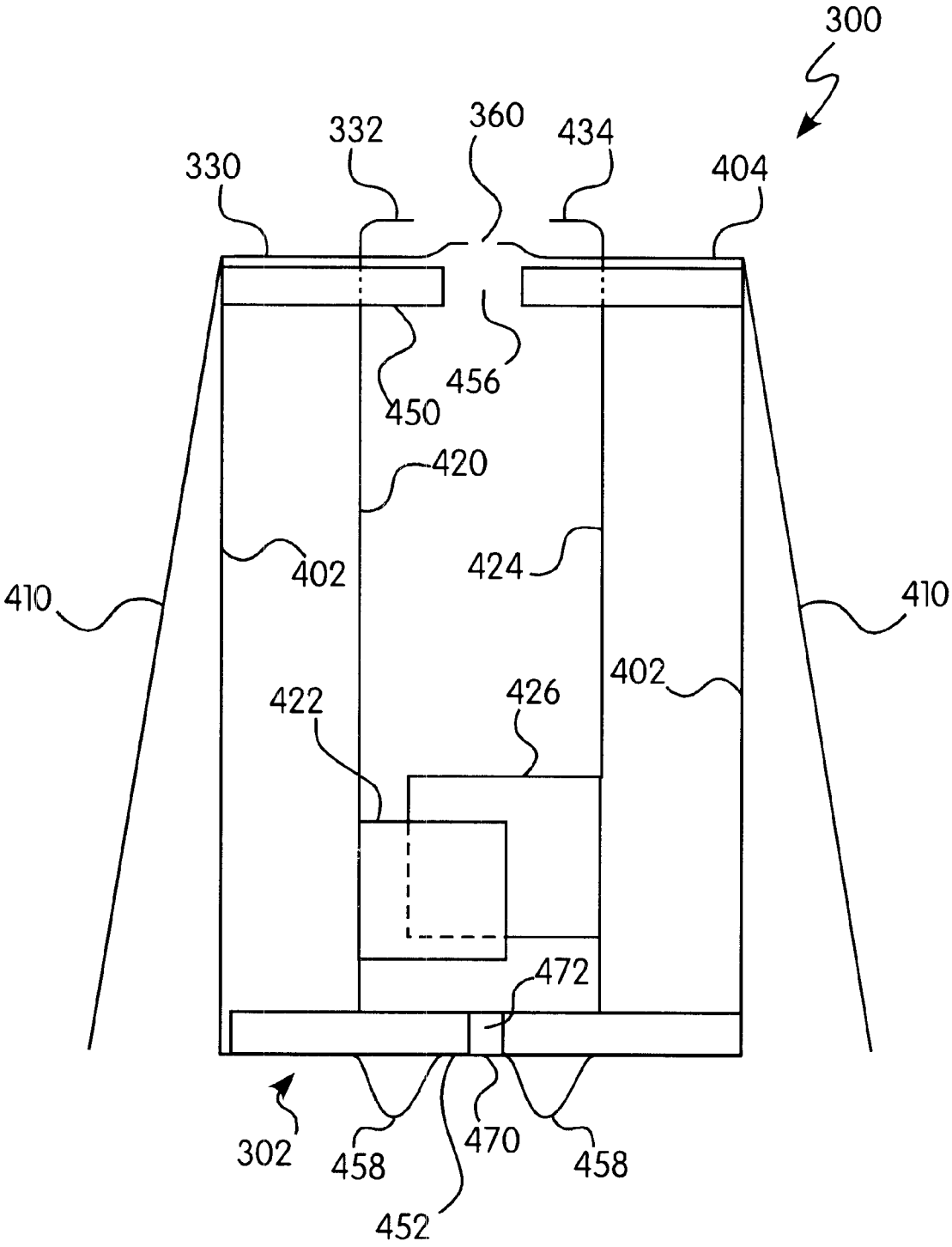
FIG. 6 is a cutaway view of a portion of a boiling chamber according to an exemplary embodiment of the present invention.

FIG. 6 is a cutaway view of a portion of a boiling 300 chamber according to an exemplary embodiment of the present invention. Extending downward from the head unit 220 is a boiling chamber 300, a hollow rectangular box with a set of side walls 402 and a top wall 404. A removable electrode cartridge 302 is inserted in the boiling chamber 300. The boiling chamber 300 includes an outer insulating wall 410 connected to the boiling chamber 300 at or near the top wall 404 of the boiling chamber 300 and forming a tapered cylinder which expands in diameter towards its bottom.

The boiling chamber 300 includes an electrode cartridge 302 containing two parallel electrodes 420 and 424, which extend vertically along the length of the boiling chamber 300. The electrode cartridge 302 includes, for example, a base comprising a top plate 450 and a bottom plate 452 which hold the electrodes 420 and 424 in place to form an integral unit. The electrodes 420 and 424 may be attached to the top plate 450 and bottom plate 452 by, for example, being embedded in the top plate 450 and the bottom plate 452, or by being screwed to the top plate 450 and the bottom plate 452. Preferably, the top plate 450 and bottom plate 452 are formed from plastic such as polypropylene or polyethylene which can withstand the heat of boiling water without deforming. The electrodes 420 and 424 are each, for example, flat stainless steel plates, one inch wide and four inches long, which are parallel and separated by a distance of approximately four inches. The electrodes 420 and 424 may be formed from a material other than stainless steel.

The electrodes 420 and 424 have electrode extensions 422 and 426, respectively, extending from the bottom portion of the electrodes 420 and 424. Each electrode extension 422 and 426 is perpendicular to the main electrode shaft, and they are spaced approximately one to one half inch from each other. In an exemplary embodiment, during operation, most current causing water heating flows between the electrode extensions 422 and 426, rather than between the electrodes 420 and 424. Preferably, the electrodes 420 and 424 are spaced far enough apart (e.g., greater than three inches) so that the current flow between them is not effective to boil water. In an alternate embodiment, a conventionally spaced set of electrodes, not having electrode extensions, may be used.

The top wall 404 of the boiling chamber 300 includes a boiling chamber connecting plate 330 for attaching the electrode cartridge 302. The top plate 450 of the electrode cartridge 302 includes a set of electrode tabs 432 and 434 which connect to the boiling chamber connecting plate 330, hold the electrode cartridge 302 in the boiling chamber 300, and provide electricity to the electrodes 420 and 424. The electrode cartridge 302 is removable. The electrode tabs 432 and 434 are electrically connected to the electrodes 420 and 424, respectively, and in an exemplary embodiment are simply extensions of the electrodes 420 and 424. The electrode tabs 432 and 434 act as bayonet connectors. The top plate 450 includes a top plate exhaust opening 456 for allowing steam and water vapor to escape the boiling chamber 300. The bottom plate 452 includes bottom plate tabs 458, allowing easy grasping and user manipulation of the boiling cartridge. The bottom plate tabs 458 may be of a configuration other than that shown; in an alternate embodiment, other methods may be used to allow a user to manipulate the boiling cartridge. The bottom plate 452 acts as a bottom wall of the boiling chamber 300. The bottom plate 452 includes an intake opening 470 for allowing water to flow from the reservoir 210 into the boiling chamber 300. Preferably the intake opening 470 is too small to allow a user easy access to the inside of the boiling chamber 300. The intake opening 470 may consist of several openings, and may include a filter 472.

To connect the electrode cartridge 302 to the boiling chamber 300, the electrode tabs 432 and 434 are placed in the electrode ports 334 and 336, respectively. The electrode tabs 432 and 434 may slide in and out of the electrode ports 334 and 336, but not in and out of the electrode slots 338 and 340. The user rotates the electrode cartridge 302, and the electrode tabs 432 and 434 slide along the electrode slots 338 and 340, respectively. The electrode tabs 432 and 434 make contact with the electrode connectors 342 and 344 and are held in place by a friction fit with the contact portions 346 and 348. The electrode tabs 432 and 434 hold the electrode cartridge 302 in place in the boiling chamber 300, and also allow for easy installation and removal of the electrode cartridge 302.

Preferably, most of the non-electrical parts of the vaporizer 200, for example the non-electrical parts of the boiling chamber 300, electrode cartridge 302, reservoir 210, and head unit 220, are formed from plastic such as polypropylene or polyethylene which can withstand the heat of boiling water without deforming.

In an exemplary embodiment, to operate the vaporizer 200, a user removes the head unit 220 from the reservoir 210 and fills the reservoir 210 with water. After replacing the head unit 220, the user plugs the power cord 222 into a wall socket and turns on the on/off switch 224. Power flows from the power cord 222 through the on/off switch 224 to the on/off indicator 226, and also to the electrode connectors 342 and 344 via the supply wires 350. When the electrode cartridge 302 is attached to boiling chamber 300, the electrode tabs 432 and 434 are in electrical contact with the electrode connectors 342 and 344, and thus power may flow to electrodes 420 and 424 to heat the water surrounding the electrodes 420 and 424 to the boiling point.

Water vapor and steam are formed in the boiling chamber 300, flow up through the top plate exhaust opening 456, through the boiling chamber outlet hole 360, through the exhaust tube 362, out of the vaporizer horn 364, and into the surrounding air. As water is evaporated from the boiling chamber 300, water flows into the boiling chamber 300 via the intake opening 470.

After a period of use scale forms on the electrodes 420 and 424 and on the inside of the boiling chamber 300, the electrodes 420 and 424 may degrade and erode, and the user will want to replace the electrode cartridge 302 and clean the boiling chamber 300. The user unplugs the power cord 222 and removes the head unit 220 from the reservoir 210. The user grasps the head unit 220 in one hand and the bottom plate tabs 458 in the other hand, and twists the electrode cartridge 302 one quarter turn counter-clockwise. The electrode tabs 432 and 434 may disengage from the electrode connectors 342 and 344 and the contact portions 346 and 348, and slide along electrode slots 338 and 340. The electrode tabs 432 and 434 then exit from the electrode ports 334 and 336, allowing the electrode cartridge 302 to become disconnected from the boiling chamber 300. The user may clean the boiling chamber 300 and refill the reservoir 210.

The user may insert a fresh electrode cartridge to the boiling chamber 300. For the purposes of explanation, the securing of a new electrode cartridge to the boiling chamber 300 will be described with respect to the electrode cartridge 302. The user grasps the head unit 220 in one hand and the bottom plate tabs 458 in the other hand, inserts the electrode tabs 432 and 434 in the electrode ports 334 and 336, and twists the electrode cartridge 302 one quarter turn clockwise. As the user rotates the electrode cartridge 302, the electrode tabs 432 and 434 slide along the electrode slots 338 and 340. The electrode tabs 432 and 434 contact the electrode connectors 342 and 344 and are held in place by a friction fit with the contact portions 346 and 348. The electrode tabs 432 and 434 hold the electrode cartridge 302 in place on the boiling chamber 300.

Preferably, the removable boiling chamber or removable electrode cartridge, the vaporizing unit and the reservoir are manufactured from durable, heat resistant plastic, except for those parts which cannot be so manufactured due to design considerations, such as electrical parts.

In an alternate exemplary embodiment, the boiling chamber may be detachable and dishwasher-safe so that after an electrode cartridge is removed, instead of cleaning the boiling chamber by hand, the boiling chamber may be placed in a dishwasher. In such an embodiment, the boiling chamber disengages from the head, for example in the manner described above. The electrode cartridge further disengages from the boiling chamber, and is disposed of, leaving an empty boiling chamber having scale buildup. The empty boiling chamber may be washed by hand or washed in a dishwasher. In a further embodiment, the electrode cartridge itself may be designed to be dishwasher-safe, and may thus easily be cleaned and replaced in the boiling chamber, obviating the need for replacement. In alternate embodiments the electrodes may be removable in other manners. For example, the electrodes may be removable individually, and need not be mounted in a cartridge. The cartridge may be of a structure other than electrodes set in a base; for example, the cartridge may be a cylinder.

A further exemplary embodiment of the vaporizer of the present invention provides for a disposable boiling chamber or electrode cartridge including mineral salts to enhance the flow of electric current between the vaporizer elements. In one such embodiment, the mineral salts are included in a pellet or nodule in a recess or container. For example, when a user first installs the boiling chamber or electrode cartridge and fills the reservoir of the vaporizer with water, the mineral salts dissolve in the water to facilitate the flow of electricity between the electrodes and thus to allow for the appropriate level of heating and boiling. As water enters and is boiled away from the chamber, minerals and scale build up in the boiling chamber and reservoir, insuring an adequate electricity flow and boiling level. In particular, in the event the boiling chamber becomes empty of water and completely dry, the electrodes will have been coated with a layer of mineral salts which originate in the pellet or nodule and possibly from the water which has been boiled away. When more water is added to the reservoir and boiling chamber, the coating of mineral salts which has collected on the electrodes dissolves and allows for fast heating and boiling.

Figure 7:
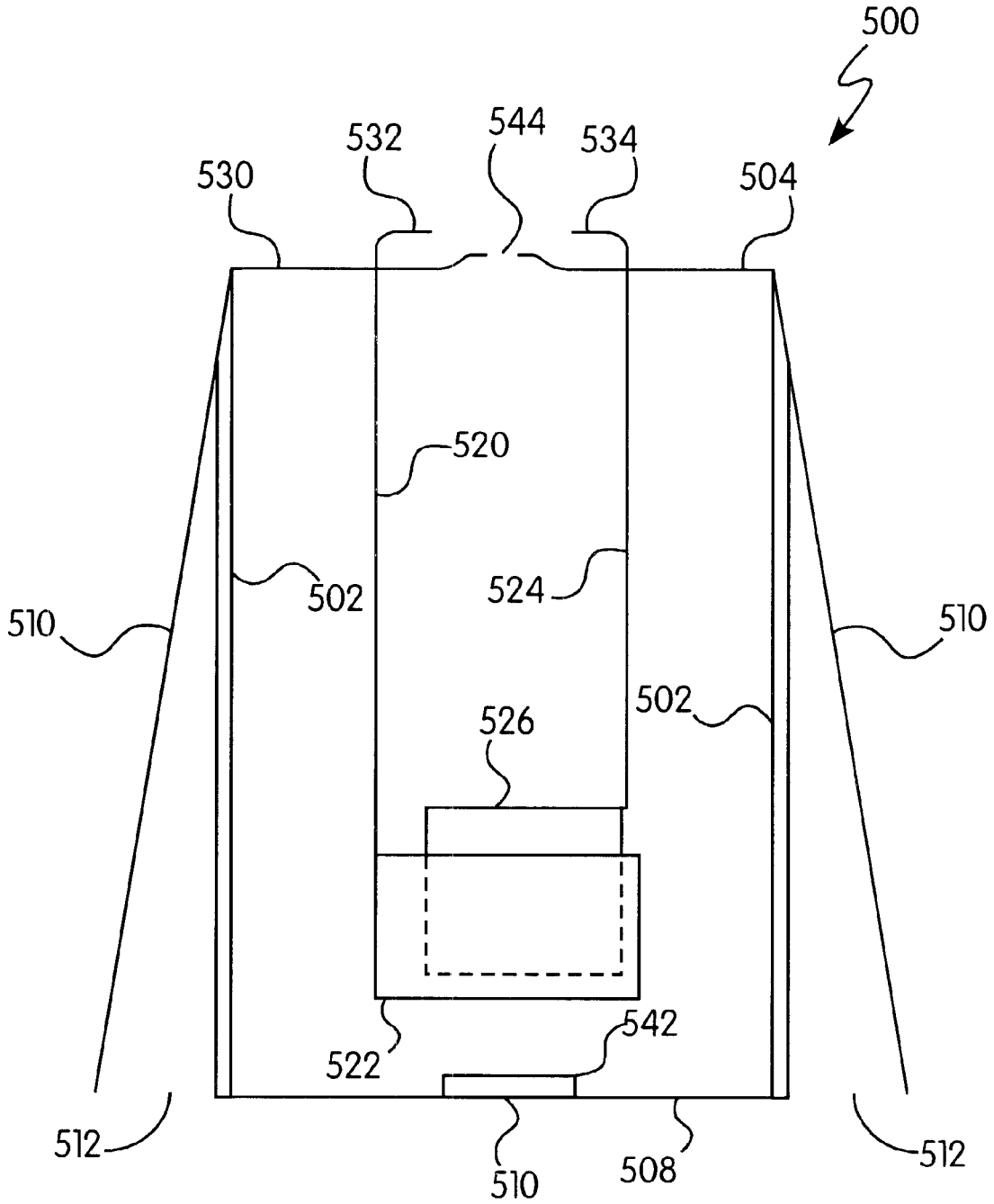
FIG. 7 is a cutaway view of a boiling chamber including a recess holding a pellet of mineral salts according to an exemplary embodiment of the present invention.

FIG. 7 is a cutaway view of a boiling chamber including a recess holding a pellet of mineral salts according to an exemplary embodiment of the present invention. The boiling chamber 500 is easily removable, replaceable and disposable, may be used with the vaporizer 1 of FIG. 1, and may attach to the head unit 20 of FIGS. 1 and 2. When attached to the head unit 20, the boiling chamber 500 extends downward from the head unit 20, and vaporizes water supplied by the reservoir 10. The boiling chamber 500 is, for example, a hollow rectangular box with a set of side walls 502, a top wall 504, and a bottom wall 508. The boiling chamber 500 further includes an outer insulating wall 510 connected to the boiling chamber 500 at or near the top wall 504 of the boiling chamber 500 which helps to define an air filled insulating area 512.

Two electrodes 520 and 524 extend substantially downward inside the boiling chamber 500 from the top wall 504. The electrodes 520 and 524 are, for example, flat plates, preferably stainless steel, one inch wide and four inches long, which are parallel and separated by a distance of approximately four inches. The electrodes 520 and 524 have, at their lower portions, electrode extensions 522 and 526, parallel plates separated by a distance of approximately one to one half inch. The boiling chamber 500 includes a boiling chamber connecting plate 530 (partially formed by the top wall 504) which connects the boiling chamber 500 to the head unit 20 (FIG. 1) by mating with the head unit connecting plate 32. The boiling chamber connecting plate 530 includes, for example, electrode tabs 532 and 534 disposed on the upper portion of the boiling chamber connecting plate 530 for joining with the head unit connecting plate 32 and for providing electricity to the electrodes 520 and 524. The electrode tabs 532 and 534 are electrically connected to the electrodes 520 and 524.

In one embodiment, the boiling chamber 500 includes a small chamber or container such as a recess 550 disposed on one of the side walls 502, for holding a mineral salt pellet 560. The recess 550 may be flush with or part of one of the side walls 502, depending on the thickness of the side walls 502, or may include a lip or ridge to expand the volume of the recess 550 without significantly decreasing the thickness of one of the side walls 502 at the point at which the recess 550 is disposed on the side walls 502. The mineral salt pellet 560 acts to facilitate boiling when the boiling chamber 500 is first used. The recess 550 is substantially open at its side facing the interior of the boiling chamber 500, to allow the mineral salt pellet 560 to dissolve. The mineral salt pellet 560 may be comprised of, for example, calcium carbonate, sodium chloride, or other appropriate minerals, and may include a binder or resin. The mineral salt pellet 560 preferably has a mass of approximately one gram; other amounts may be used as appropriate. The mineral salt pellet 560 may be inserted into the recess 550 using known manufacturing methods. In alternate embodiments, other substances may be used to facilitate boiling in a vaporizer.

The bottom wall 508 of the boiling chamber 500 includes an intake opening 540 for allowing water to flow from the reservoir 10, and may include a filter 542. The top wall 504 includes a boiling chamber exhaust opening 544 for allowing steam and water vapor to flow out of the boiling chamber 500. Preferably the boiling chamber exhaust opening 544 and the intake opening 540 are too small to allow a user easy access to the inside of the boiling chamber 500. Preferably the boiling chamber 500 is a substantially sealed enclosure. The non-electrical parts of the boiling chamber 500 may be formed from plastic such as polypropylene or polyethylene which can withstand the heat of boiling water.

In an alternate embodiment, a different sort of chamber or container for holding a mineral salt may be used. For example, a boiling chamber may be fitted with an open topped cup having inside packed mineral salts. The cup is filled with, for example, a solid block of salt in such a manner that the salt may not be easily removed from or fall out of the cup while the cup is dry, but may dissolve when water fills the interior of the cup. A chamber, recess or container holding mineral salts need not be located on the side of the boiling chamber, but may be positioned at any point within the boiling chamber. Such a chamber need not be integral with the boiling chamber, but may be a separate piece which is attached to the boiling chamber. In a further embodiment, a mineral salt spray may be applied to the inside of the boiling chamber and/or to the electrodes using known methods.

The operation of the boiling chamber 500 in conjunction with the vaporizer 1 and head unit 20 is substantially similar to that of the boiling chamber 100 of FIG. 3. A user fills the reservoir 10 with water and replaces the head unit 20, with boiling chamber 500 attached, in the reservoir 10. As water fills the boiling chamber 500 for the first time, the mineral salt pellet 560 dissolves, preferably completely. After the user turns on the on/off switch 24, power flows to the electrodes 520 and 524. Depending on the mineral content of the water added to the vaporizer 1, if no minerals from the mineral salt pellet 560 had been dissolved in the water, the initial boiling may have been slow, or, in some cases, nonexistent. However, since the salt pellet 560 has been dissolved in the water, the voltage supplied to the electrodes 520 and 524 is able to easily flow through the water and to heat the water in the boiling chamber 500 to the boiling point. As water is added to and boiled away from the boiling chamber 500, minerals (and scale) build up in the boiling chamber 500 and in the reservoir 10, insuring an adequate electricity flow and boiling level. Water vapor and steam are formed in the boiling chamber 500 and flow into the surrounding air.

As with the boiling chamber 100 of FIG. 3, undesirable scale may form on the electrodes 520 and 524 and on the inside of the boiling chamber 500, and it may be removed and replaced. The user grasps the head unit 20 and the boiling chamber 500 and twists the boiling chamber 500 one quarter turn counter-clockwise. The electrode tabs 532 and 534 may disengage from the electrode connectors 42 and 44 and the contact portions 46 and 48, and slide along the electrode slots 38 and 40. The electrode tabs 532 and 534 then exit from the electrode ports 34 and 36, allowing the boiling chamber 500 to become disconnected from the head unit 20. Following a similar, but reversed, procedure, a user may attach a new boiling chamber having a recess with a mineral salt pellet.

A chamber or recess for holding a mineral salt may be used with the replaceable electrode cartridge 302 of FIG. 6. For example, an electrode cartridge similar to electrode cartridge 302 may be fitted with a recess having inside a mineral salt pellet, located on one of the top plate 450 or the bottom plate 452. Alternately, a mineral salt spray may be applied to the electrodes 420 and 424 of such an electrode cartridge using known methods. When replacing the electrode cartridge, the user may clean the reservoir and boiling chamber, thus removing a coating of mineral salts which may have collected on the surfaces of the reservoir and boiling chamber. However, the new, replacement electrode cartridge may contain a mineral salt pellet or coating.

In a further embodiment, a mineral salt pellet or coating may be used with a vaporizer having permanent components not meant to be regularly replaced. A recess or container containing a mineral salt pellet may be provided on components of such a vaporizer, or a mineral salt coating may be provided on the surfaces of the components. After a period of operation, the electrodes become coated with a layer of mineral salts which originate in the pellet or coating and possibly from the water which has been boiled away. In such an embodiment, if, after the reservoir and boiling chamber become empty of water and completely dry, and the user completely cleans the reservoir, boiling chamber, and electrodes, the benefit of the coating of mineral salts which has collected on the electrodes will be lost. However, the user may be instructed not to clean the electrodes. In such a case, the dissolved minerals on the electrodes act to encourage boiling when fresh water is added to the boiling chamber. While the system and method of the present invention is described with respect to specific embodiments, it should be noted that the invention may be implemented in different manners and used with different applications. In an alternate embodiment the electrodes need not be of the size, shape and configuration shown. For example, the electrodes need not extend the length of the boiling chamber; if the electrodes are in a removable cartridge the cartridge may extend the length of the chamber to enable removal. In an alternate embodiment, a removable electrode cartridge may be of a different configuration, having a different base; for example, the top plate or the bottom plate need not be required. In an alternate embodiment, the connector arrangement for a removable boiling chamber or removable electrode cartridge may take different forms, using other known connection methods. For example, a boiling chamber or cartridge may snap on to a head unit without turning, may screw in using threaded connectors, or may be attached using a friction fit. In addition, the mechanisms for easy gripping of the cartridge or boiling chamber described may be of different mechanisms, or may not be used. A user may achieve enough gripping power on a purely cylindrical boiling chamber or cartridge.

What is claimed is:

1. A vaporizer comprising:

a boiling chamber;

a reservoir holding water and providing water to the boiling chamber;

a mineral salt pellet integrally disposed in the boiling chamber; and a container disposed within the boiling chamber, wherein the mineral salt pellet is contained in the container.

2. The vaporizer of claim 1 wherein the boiling chamber includes a wall, and the container is a recess in the wall.

3. The vaporizer of claim 2 wherein the boiling chamber is removable with respect to the reservoir.

4. The vaporizer of claim 3 wherein the boiling chamber is a substantially sealed enclosure.

5. The vaporizer of claim 2 wherein the boiling chamber includes a removable electrode cartridge.

6. The vaporizer of claim 1 wherein the container is a cup.

7. The vaporizer of claim 1 wherein the mineral salt pellet includes sodium chloride.

8. A method of using a vaporizer comprising:

providing a boiling chamber;

providing water to the boiling chamber from a reservoir holding water;

generating vapor from water in the boiling chamber wherein a boiling inducing agent is integrally disposed in the boiling chamber and wherein the boiling chamber has a container disposed within, and the boiling inducing agent is disposed within.

9. The method of claim 8, wherein the boiling chamber includes a wall, and the container is a recess in the wall.

10. The method of claim 9, wherein the boiling chamber is removable with respect to the reservoir.

11. The method of claim 10, wherein the boiling chamber is a substantially sealed enclosure.

12. The method of claim 9, wherein the boiling chamber includes a removable electrode cartridge.

13. The method of claim 8, wherein the container is a cup.

* * * * *